US009885510B2

(12) United States Patent
Son et al.

(10) Patent No.: US 9,885,510 B2
(45) Date of Patent: Feb. 6, 2018

(54) REFRIGERATOR

(71) Applicant: LG Electronics Inc., Seoul (KR)

(72) Inventors: Juhyun Son, Seoul (KR); Donghoon Lee, Seoul (KR); Wookyong Lee, Seoul (KR); Donghoon Lee, Seoul (KR); Dongjeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 927 days.

(21) Appl. No.: 13/915,742

(22) Filed: Jun. 12, 2013

(65) Prior Publication Data

US 2013/0327082 A1 Dec. 12, 2013

(30) Foreign Application Priority Data

Jun. 12, 2012 (KR) ..... 10-2012-0062435

(51) Int. Cl.
*F25C 5/00* (2006.01)
*F25C 1/00* (2006.01)
(Continued)

(52) U.S. Cl.
CPC ..... *F25C 5/005* (2013.01); *F25C 1/00* (2013.01); *F25C 1/04* (2013.01); *F25C 1/24* (2013.01);
(Continued)

(58) Field of Classification Search
CPC ..... F25C 5/005; F25C 5/007; F25C 5/002; F25C 2400/04; F25C 2500/08; F25C 5/187; F25D 23/061
See application file for complete search history.

(56) References Cited

U.S. PATENT DOCUMENTS 3,390,537 A * 7/1968 Callen ..... F25C 5/002 221/83
5,345,783 A 9/1994 Nishikawa
(Continued)

FOREIGN PATENT DOCUMENTS

CN 1087166 A 5/1994
CN 101529174 A 9/2009
(Continued)

OTHER PUBLICATIONS

Chinese Office Action and Search Report dated Feb. 2, 2015 for Chinese Application No. 201310232887.2, with English Translation, 18 pages.
(Continued)

*Primary Examiner* — Carlos A Rivera
*Assistant Examiner* — Marcos O Diaz
(74) *Attorney, Agent, or Firm* — Fish & Richardson P.C.

(57) ABSTRACT

A refrigerator includes a main body including a freezing compartment and a refrigerating compartment, a door, and an ice maker disposed in the freezing compartment. The refrigerator also includes an ice bank disposed on the door, an ice transfer device configured to transfer ice made in the ice maker to the ice bank, and an ice chute that connects the ice transfer device to the ice bank. The ice transfer device includes a housing in which ice separated from the ice maker drops and a transfer member accommodated within the housing and configured to transfer ice from the housing into the ice chute. The ice transfer device also includes an ice unit configured to reduce ice jamming or damage caused by interference with the transfer member.

11 Claims, 15 Drawing Sheets

(51) Int. Cl.

| | |
|---|---|
| ***F25C 5/18*** | (2006.01) |
| ***F25C 1/04*** | (2006.01) |
| ***F25C 1/24*** | (2006.01) |
| *F25D 11/02* | (2006.01) |

(52) U.S. Cl.
CPC ..... *F25C 5/002* (2013.01); *F25C 5/182* (2013.01); *F25C 2500/08* (2013.01); *F25D 11/02* (2013.01)

(56) References Cited

U.S. PATENT DOCUMENTS

| | | | | |
|---|---|---|---|---|
| 8,746,002 | B2 | 6/2014 | Lee | |
| 2006/0086127 | A1* | 4/2006 | Anselmino | F25C 5/182 62/340 |
| 2006/0283202 | A1 | 12/2006 | Oh | |
| 2008/0016899 | A1 | 1/2008 | Anselmino | |
| 2009/0145158 | A1 | 6/2009 | Anselmino | |
| 2009/0193832 | A1 | 8/2009 | Lee | |
| 2010/0313593 | A1 | 12/2010 | Lee | |
| 2011/0094253 | A1* | 4/2011 | Kalashnikov | F25C 5/005 62/344 |
| 2011/0094254 | A1* | 4/2011 | Kim | F25C 1/04 62/344 |
| 2011/0094255 | A1 | 4/2011 | Jeffery | |
| 2011/0138842 | A1* | 6/2011 | Chase | F25C 5/187 62/344 |
| 2012/0023999 | A1* | 2/2012 | Oh | F25C 5/005 62/344 |
| 2012/0024001 | A1 | 2/2012 | Oh | |
| 2012/0292350 | A1* | 11/2012 | de Paula | F25C 5/005 222/504 |
| 2012/0324940 | A1 | 12/2012 | Anselmino | |

FOREIGN PATENT DOCUMENTS

| | | | |
|---|---|---|---|
| CN | 102261780 | A | 11/2011 |
| EP | 1 653 174 | A2 | 5/2006 |
| JP | S 58-074073 | U | 5/1983 |
| KR | 10-2010-0136788 | | 12/2010 |
| KR | 10-2011-0037609 | A | 4/2011 |
| WO | WO 2008/050991 | A2 | 5/2008 |
| WO | WO 2008/054161 | A2 | 5/2008 |

OTHER PUBLICATIONS

European Search Report dated Jan. 27, 2014 for EP Application No. 13171247, 10 pages.

European Communication pursuant to Article 94(3) EPC in European Application No. 13171247.3, dated Aug. 3, 2017, 9 pages (with English translation).

* cited by examiner

REFRIGERATOR

CROSS-REFERENCE TO RELATED APPLICATIONS

The present application claims the benefit of priority to Korean Patent Application No. 10-2012-0062435 filed on Jun. 12, 2012, which is herein incorporated by reference in its entirety.

FIELD

The present disclosure relates to a refrigerator.

BACKGROUND

In general, refrigerators are home appliances for storing foods at a low temperature in an inner storage space covered by a door. That is, since a refrigerator cools the inside of a storage space by using cool air generated through heat-exchange with a refrigerant circulating a refrigeration cycle, foods stored in the storage space may be stored in an optimum state.

FIG. 1 illustrates a prior art refrigerator, and FIG. 2 illustrates a cool air circulation state inside the refrigerator shown in FIG. 1 and an ice making compartment.

Referring to FIGS. 1 and 2, a refrigerator 1 includes a cabinet 10 defining a storage space and doors 20 and 30 rotatably mounted on the cabinet 10. Here, an outer appearance of the refrigerator 1 may be defined by the cabinet 10 and the doors 20 and 30.

The storage space within the cabinet 10 is vertically partitioned by a barrier 11. A refrigerating compartment 12 is defined in the partitioned upper side, and a freezing compartment 13 is defined in the partitioned lower side.

The doors 20 and 30 include a refrigerating compartment door 20 for opening or closing the refrigerating compartment 12 and a freezing compartment door 30 for opening or closing the freezing compartment 13. Also, the refrigerating compartment door 20 includes a pair of doors disposed on left and right sides thereof. The pair of doors includes a first refrigerating compartment door 21 and a second refrigerating compartment door 22 disposed on a right side of the first refrigerating compartment door 21. The first refrigerating compartment door 21 and the second refrigerating compartment door 22 independently rotate with respect to each other.

The freezing compartment door 30 may be provided as a slidably accessible door. The freezing compartment door 30 may be vertically provided in plurality. The freezing compartment door 30 may be provided as one door as needed.

A dispenser 23 for dispensing water or ice is disposed in one of the first refrigerating compartment door 21 and the second refrigerating compartment door 22. For example, a structure in which the dispenser 23 is disposed in the first refrigerating compartment door 21 is illustrated in FIG. 1.

An ice making compartment 40 for making and storing ice is defined in the first refrigerating compartment door 21. The ice making compartment 40 is provided as an independent insulation space. The ice making compartment 40 may be opened or closed by an ice making compartment door 41. An ice maker for making ice may be provided within the ice making compartment 40. Also, components for storing made ice or dispensing the made ice through the dispenser 23 may be provided in the ice making compartment 40.

Also, a cold air duct 50 for supplying cool air into the ice making compartment 40 and recovering the cool air from the ice making compartment 40 is disposed in a side wall of the cabinet 10. Further, a cool air inlet 42 and a cool air outlet 43 which communicate with the cold air duct 50 when the first refrigerating compartment door 21 is closed are provided in one surface of the ice making compartment 40. Cool air introduced into the cool air inlet 42 cools the inside of the ice making compartment 40 to make ice. Then, the heat-exchanged cool air is discharged to the outside of the ice making compartment 40 through the cool air outlet 43.

A heat exchange chamber 14 partitioned from the freezing compartment 13 is defined in a rear side of the freezing compartment 13. An evaporator is provided in the heat exchange chamber 14. Cool air generated in the evaporator may be supplied into the freezing compartment 13, the refrigerating compartment 12, and the ice making compartment 40 to cool the inside of each of the freezing compartment 13, the refrigerating compartment 12, and the ice making compartment 40.

Also, the cold air duct 50 communicates with the heat exchange chamber 14 and the freezing compartment 13. Thus, cool air within the heat exchange chamber 14 is introduced into the ice making compartment 40 through a supply passage 51 of the cold air duct 50. Further, cool air within the ice making compartment 40 is recovered into the freezing compartment 13 through a recovery passage 52 of the cold air duct 50. In addition, ice is made and stored within the ice making compartment 40 by continuous circulation of the cool air through the cold air duct 50.

In the refrigerator having the above-described structure, the making and storage of ice is performed within the ice making compartment 40 provided on the refrigerating compartment door 20 to increase a volume of the refrigerating compartment door 20. Thus, an accommodation space defined in a back surface of the refrigerating compartment door 20 may be reduced.

Also, since cool air for making ice is supplied up to the ice making compartment, power consumption may increase.

SUMMARY

In one aspect, a refrigerator includes a main body comprising a freezing compartment and a refrigerating compartment, a door configured to open and close at least a portion of the refrigerating compartment, and an ice maker disposed in the freezing compartment. The refrigerator also includes an ice bank disposed on the door and configured to store ice made in the ice maker, an ice transfer device configured to transfer ice made in the ice maker to the ice bank, and an ice chute that connects the ice transfer device to the ice bank and defines a transfer path for ice from the ice transfer device to the ice bank. The ice transfer device includes a housing in which ice separated from the ice maker drops and a transfer member accommodated within the housing and configured to transfer ice from the housing into the ice chute. The ice transfer device also includes an ice unit configured to reduce ice jamming or damage caused by interference with the transfer member based on at least one of ice being transferred into the ice chute by the transfer member and ice being transferred from the ice chute toward the transfer member.

Implementations may include one or more of the following features. For example, the ice maker may include an upper plate tray having a plurality of hemispherical recess parts that define an upper half of a spherical ice piece and a lower plate tray having a plurality of hemispherical recess parts that define a lower half of the spherical ice piece. In this example, the lower plate tray may be rotatably connected to the upper plate tray.

In some implementations, the refrigerator may include a cold air duct that connects the freezing compartment to the ice bank. In these implementations, the ice chute and the cold air duct may extend along a side surface of the main body and communication holes configured to communicate with openings of the ice chute and the cold air duct may be defined in a side surface of the ice bank. The communication holes may be configured to communicate with the openings of the ice chute and the cold air duct based on the door being oriented in a closed position.

In some examples, the housing may include an ice bin in which ice separated from the ice maker is temporarily stored and a transfer case disposed at an outlet of the ice bin and configured to accommodate the transfer member. In these examples, an inlet of the ice chute may be connected to the transfer case.

In some implementations, the transfer member may include a plurality of lifters that radially extend from a rotation center of the transfer member. In these implementations, ice supplied from the ice bin may be accommodated in an accommodation space defined between adjacent lifters.

In addition, the ice unit may include a tensioner configured to push an ice piece introduced into the accommodation space and an elastic member configured to apply an elastic force to the tensioner. Also, the ice unit may be disposed at a location where the ice chute and the transfer case are connected to each other and may include a single plate made of a flexible material. Further, the refrigerator may include an auger provided within the ice bin and configured to transfer ice toward the transfer case.

In some examples, the ice unit may be disposed at a location where the ice chute and the transfer case are connected to each other. In these examples, the ice unit may include a tensioner that includes a plurality of plates connected to each other, the plurality of plates being rotatable with respect to each other at one or more connection portions, and an elastic member configured to apply an elastic force to the tensioner. Also, in these examples, the tensioner may have a first end slidably connected to the ice chute and a second end rotatably connected to the transfer case and the elastic member may include a torsion spring fitted into a connection portion between the second end of the tensioner and the transfer case. Further, in these examples, at least one of the connection portions of the plurality of plates may establish a rotation joint such that the tensioner bends at the rotation joint according to a load or size of ice passing through the tensioner.

In some implementations, the ice unit may include a tensioner placed at a bottom of the accommodation space and an elastic member connected to a bottom surface of the tensioner and configured to move the tensioner in a radial direction of the transfer member according to size or weight of ice dropped into the accommodation space. In these implementations, the refrigerator may include guide holes defined in both side surfaces of the transfer member. Both side ends of the tensioner may be fitted in the guide holes and a maximum limit of movement of the tensioner in the radial direction may correspond to a length of each guide hole in the radial direction.

In addition, the ice unit may be configured to reduce ice jamming or damage caused by interference with the transfer member based on ice being transferred into the ice chute by the transfer member. Further, the ice unit may be configured to reduce ice jamming or damage caused by interference with the transfer member based on ice being transferred from the ice chute toward the transfer member.

The ice unit may include a tensioner configured to push an ice piece being moved by the transfer member and an elastic member configured to apply an elastic force to the tensioner. The ice unit may include a tensioner that includes a plurality of plates connected to each other and an elastic member configured to apply an elastic force to the tensioner. The plurality of plates may be rotatable with respect to each other at one or more connection portions.

Also, the ice unit may be disposed at a location where the ice chute and the transfer case are connected to each other and may include a single plate made of a flexible material. Further, the ice unit may include a tensioner placed at a bottom of the transfer member and an elastic member connected to a bottom surface of the tensioner and configured to move the tensioner in a radial direction of the transfer member according to size or weight of ice being transferred by the transfer member.

The details of one or more implementations are set forth in the accompanying drawings and the description below. Other features will be apparent from the description and drawings, and from the claims.

DETAILED DESCRIPTION

Figure 1:
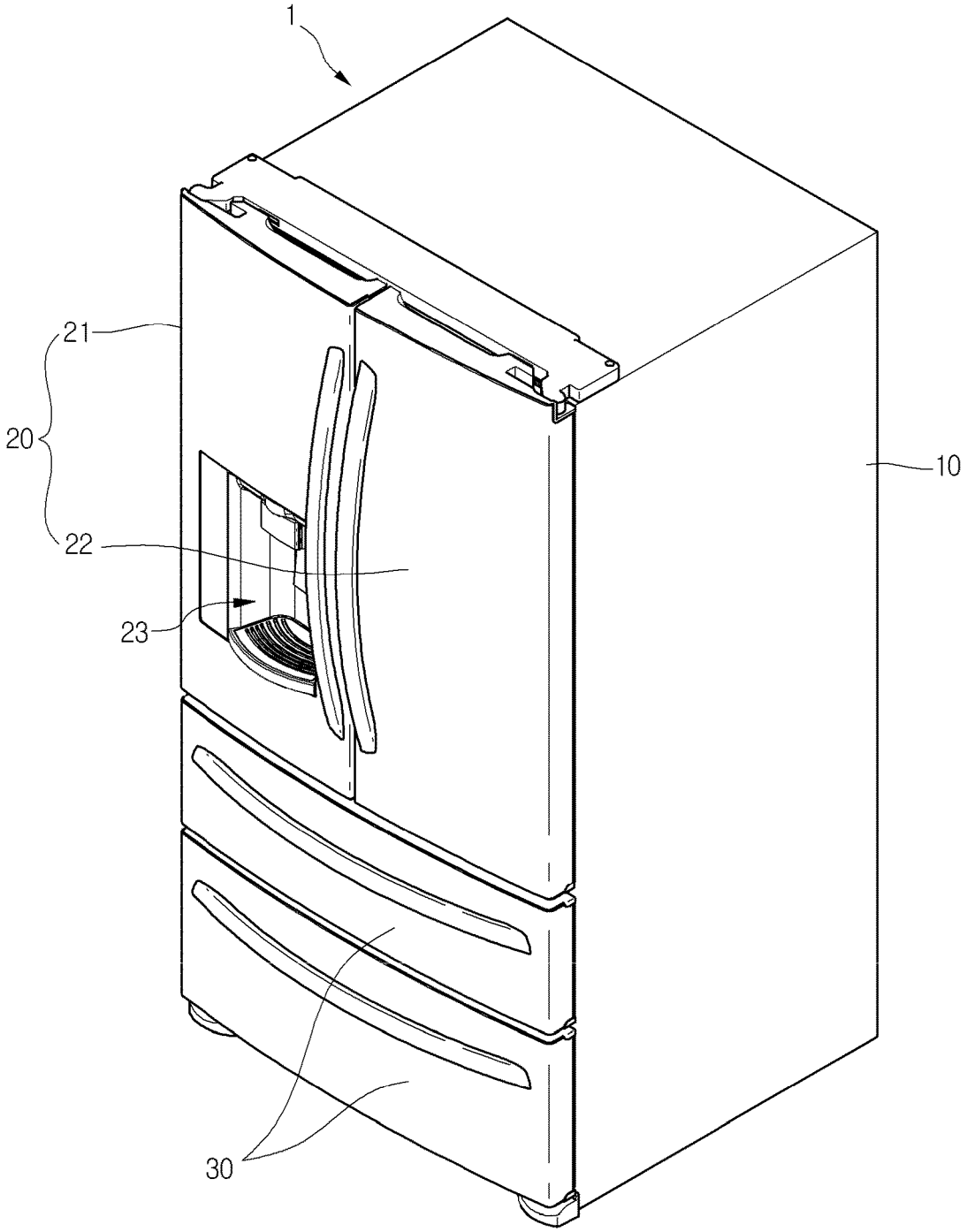
FIG.1 Related Art
FIG. 1 is a perspective view of an example prior art refrigerator.
Figure 2:
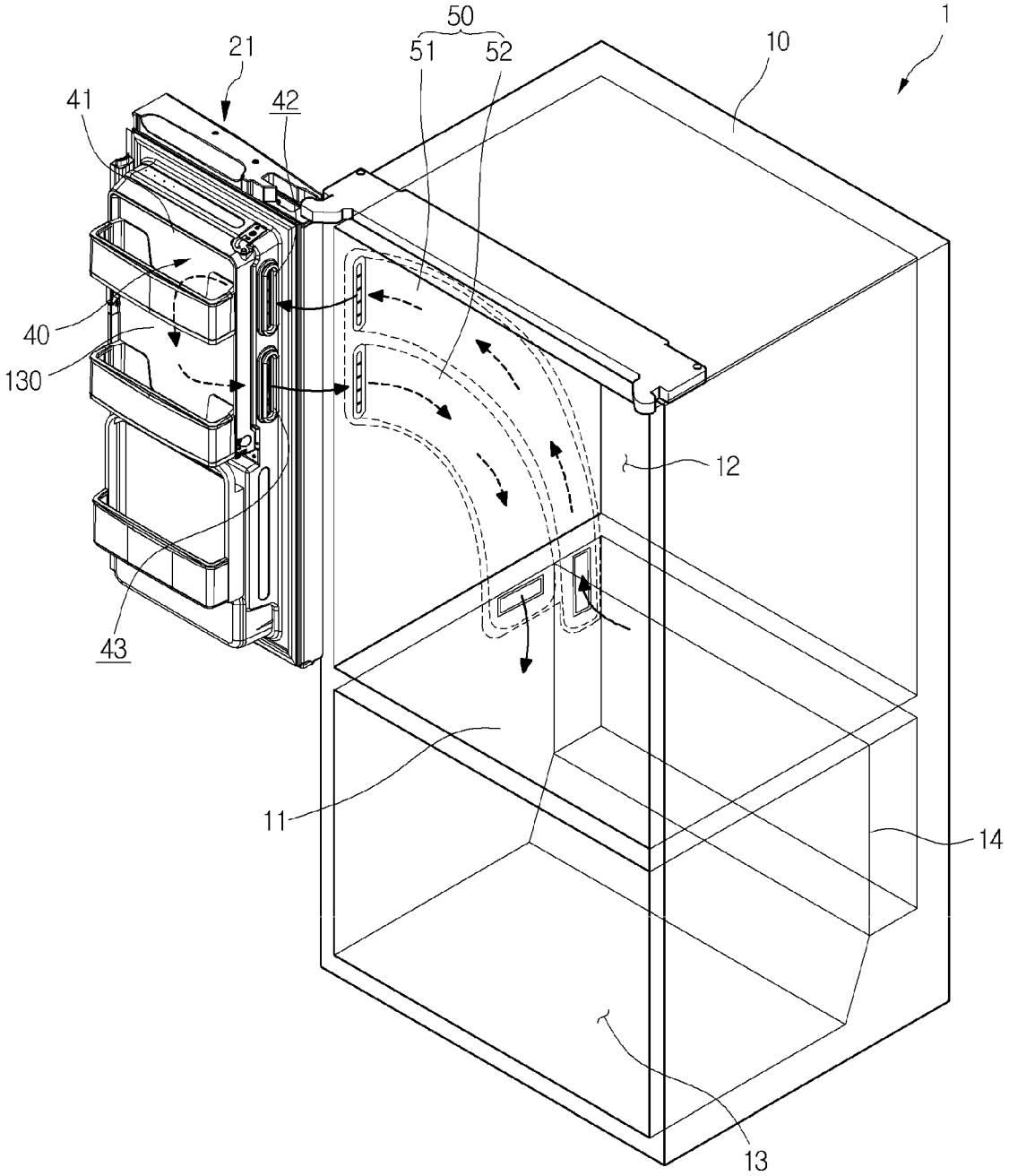
FIG.2 Related Art
FIG. 2 is a perspective view illustrating an example cool air circulation state within the refrigerator shown in FIG. 1 and an example ice making compartment.
Figure 3:
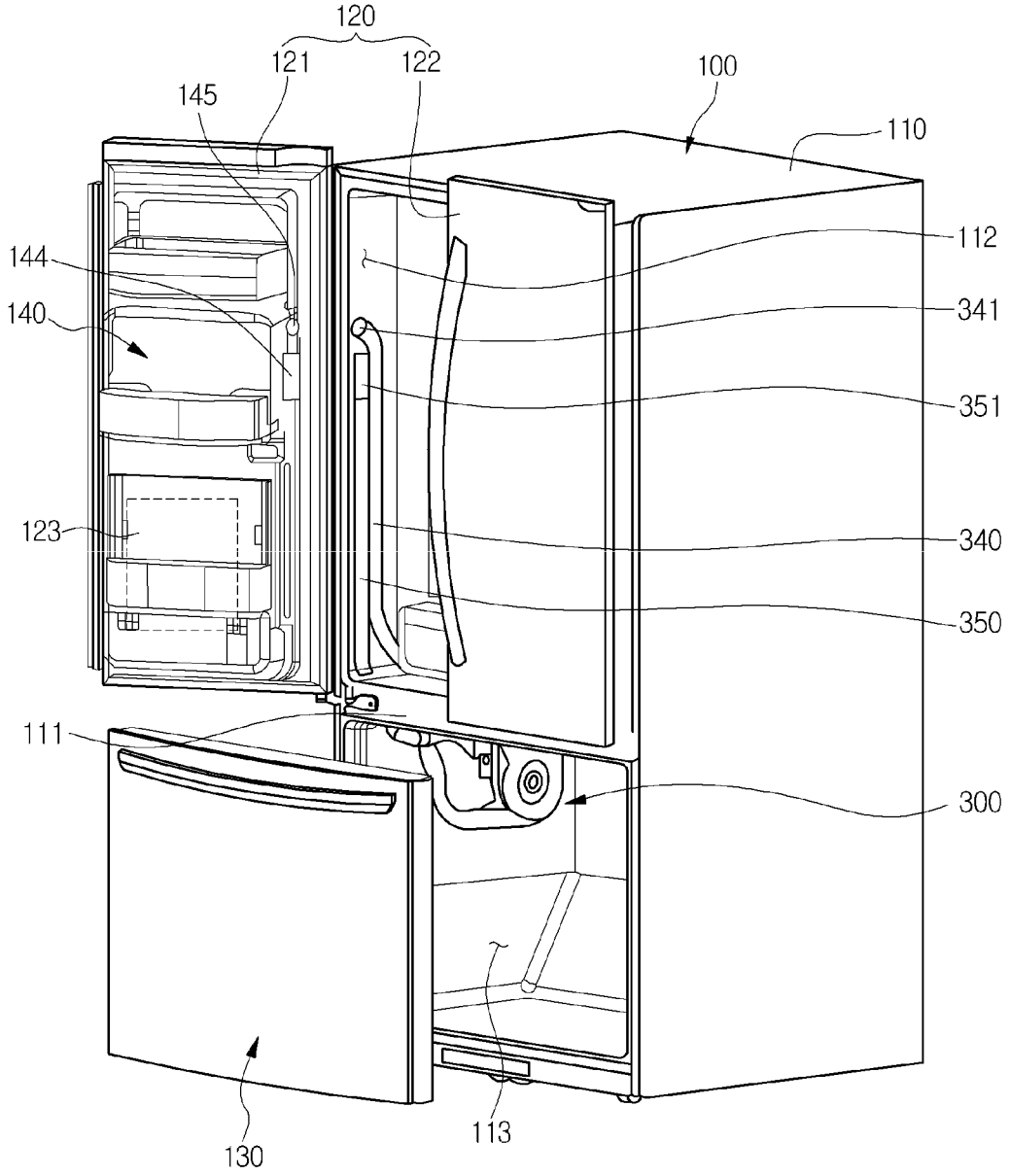
FIG. 3 is a perspective view of an example refrigerator.
Figure 4:
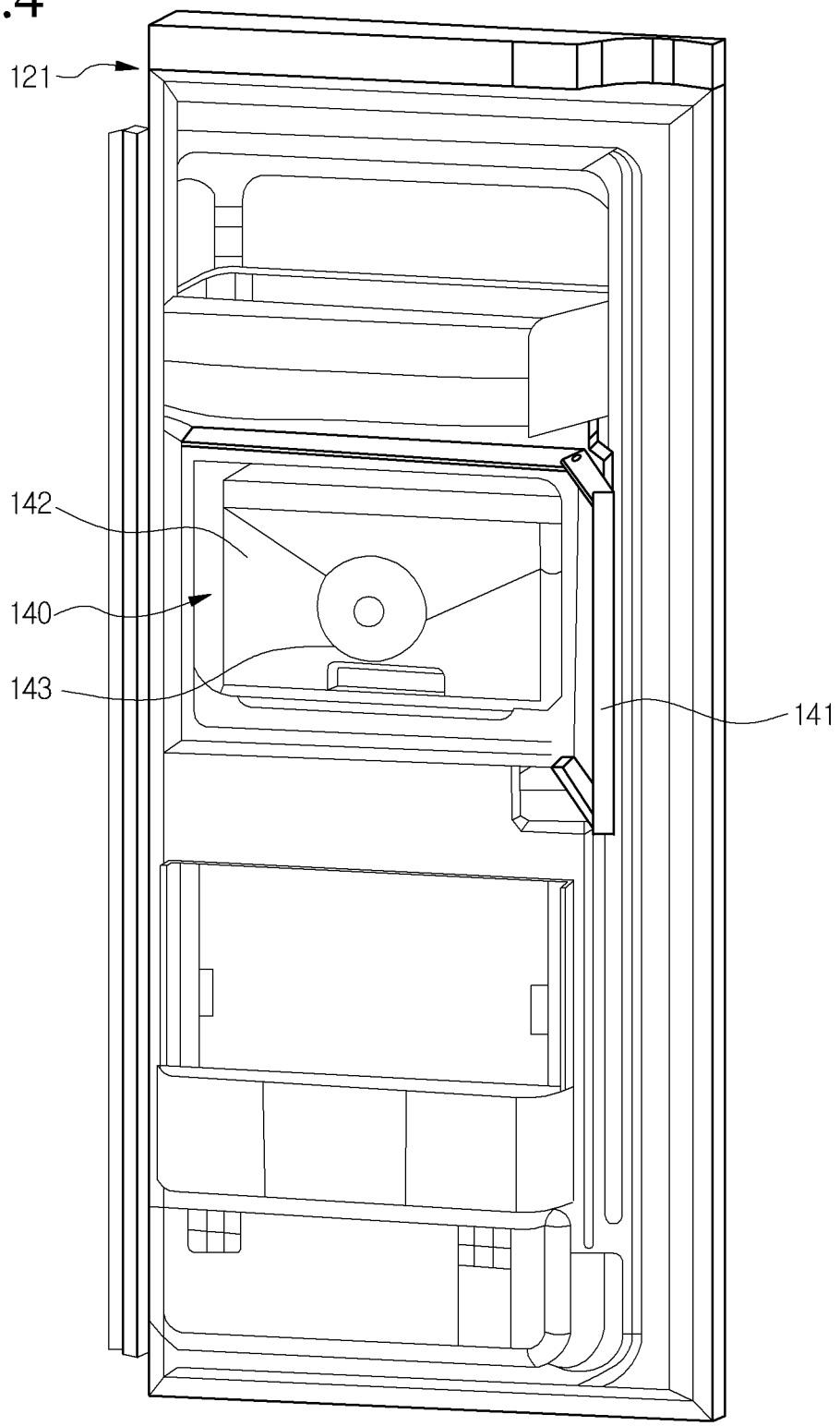
FIG. 4 is a perspective view illustrating an example ice maker of the refrigerator shown in FIG. 1.
Figure 5:
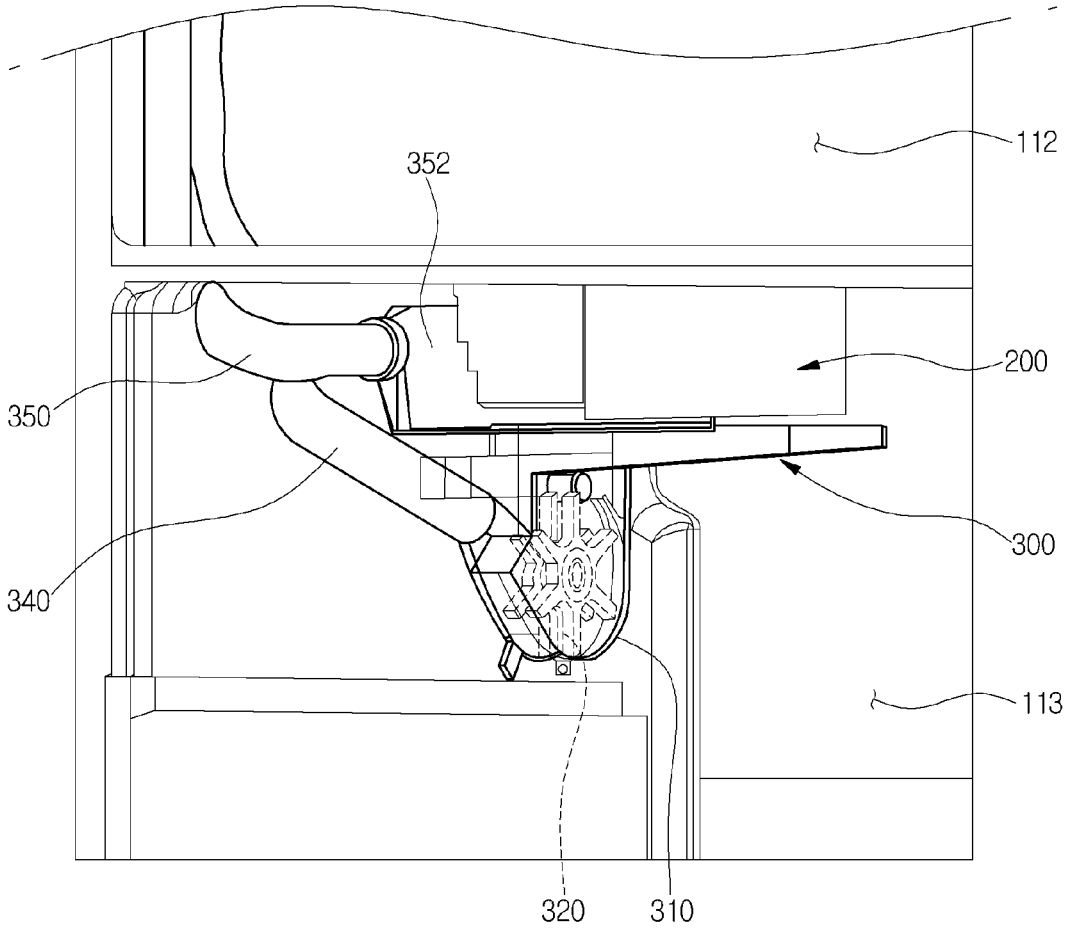
FIG. 5 is a partially perspective view illustrating an example inner structure of an example freezing compartment.

FIG. 3 illustrates an example refrigerator, FIG. 4 illustrates an example ice maker of the refrigerator shown in FIG. 1, and FIG. 5 illustrates an example inner structure of an example freezing compartment.

Referring to FIGS. 3 to 5, a refrigerator 100 includes a cabinet 110 and a door. Here, the cabinet 110 and the door define an outer appearance of the refrigerator 100. The inside of the cabinet 110 is partitioned by a barrier 111. That is, a refrigerating compartment 112 is defined at an upper side, and a freezing compartment 113 is defined at a lower side.

An ice maker 200 for making ice and an ice transfer device 300 for transferring the made ice into an ice bank 140 may be provided within the freezing compartment 113.

The door includes a refrigerating compartment door 120 for covering the refrigerating compartment 112 and a freezing compartment door 130 for covering the freezing compartment 113. The refrigerating compartment door 120 includes a first refrigerating compartment door 121 and a second refrigerating compartment door 122 which respectively rotate to open or close the refrigerating compartment 112. Also, the freezing compartment door 130 may be slidably withdrawn in front and rear directions to open or close the freezing compartment 113.

A dispenser 123 may be provided in a front surface of the first refrigerating compartment door 121. Purified water and ice made in the ice maker 200 may be dispensed to the outside through the dispenser 123.

The ice bank 140 is provided on a back surface of the refrigerating compartment door 120. The ice bank 140 provides a space for storing ice transferred by the ice transfer device 300. Also, the ice bank 140 may be openable by a door 141. The ice bank 140 defines an insulation space. In addition, when the first refrigerating compartment door 121 is closed, the ice bank 140 is connected to the ice chute 340 and the cold air duct 350 to allow ice to be supplied and cool air to be circulated. The ice bank 140 communicates with the dispenser 123. Thus, when the dispenser 123 is manipulated, ice stored in the ice bank 140 may be dispensed. Further, a separate case 142 for accommodating ice may be provided within the ice bank 140. Also, an auger 143 configured to smoothly transfer ice and a crusher for crushing ice to dispense ice pieces may be further provided within the ice bank 140.

In some examples, the ice bank 140 protrudes backward to allow a side surface part of the ice bank 140 to contact an inner wall of the refrigerating compartment 112 when the first refrigerating compartment door 121 is closed. In these examples, an air hole 144 and an ice inlet hole 145 may be further defined in a sidewall of the ice bank 140 corresponding to the openings 341 and 351 of the ice chute 340 and the cold air duct 350, which are disposed in the inner sidewall of the refrigerating compartment 112. Thus, when the first refrigerating compartment door 121 is closed, ice may be transferred into the ice bank 140, and also, cool air for maintaining a frozen state of the ice may be supplied.

A withdrawable drawer, the ice maker 200, and the ice transfer device 300 may be disposed inside the freezing compartment 113.

The ice maker 200 is configured to make ice by using water supplied from a water supply source. The ice maker 200 may be disposed in the vicinity of an upper edge of the freezing compartment 113. The ice maker 200 is fixedly mounted on a bottom surface of the barrier 111. The ice made in the ice maker 200 may drop down and then be accommodated in a housing 310 of the ice transfer device 300.

Also, the ice transfer device 300 may be disposed under the ice maker 200 to supply the ice made in the ice maker 200 into the ice bank 140. Here, the positions of the ice maker 200 and the ice transfer device 300 may be determined according to the position of the ice bank 140. For example, the ice maker 200 and the ice transfer device 300 may be provided in an upper left portion of the freezing compartment 113 that corresponds to the shortest distance from the ice bank 140 disposed in the first refrigerating compartment door 121.

For instance, the ice transfer device 300 may be disposed under the ice maker 200 and fixedly mounted on a sidewall of the freezing compartment 113. Also, a transfer member 320 for transferring ice may be disposed within the housing 310. The housing 310 is connected to the ice chute 340 to transfer the made ice into the ice bank 140 through the ice chute 340. In addition, an end of the cold air duct 350 is disposed on a side of the ice transfer device 300. The cold air duct 350 is configured to supply the cool air within the freezing compartment 113 into the ice bank 140. An inlet of the cold air duct 350 may be exposed to the inside of the freezing compartment 113, and a cool air suction part 352 in which a blower fan 353 (see FIG. 7) is accommodated may be further disposed on an inlet-side of the cold air duct 350. The cool air suction part 352 communicates with an evaporating chamber in which an evaporator is disposed to allow cool air within the evaporating chamber to be supplied into the ice bank 140.

Figure 6:
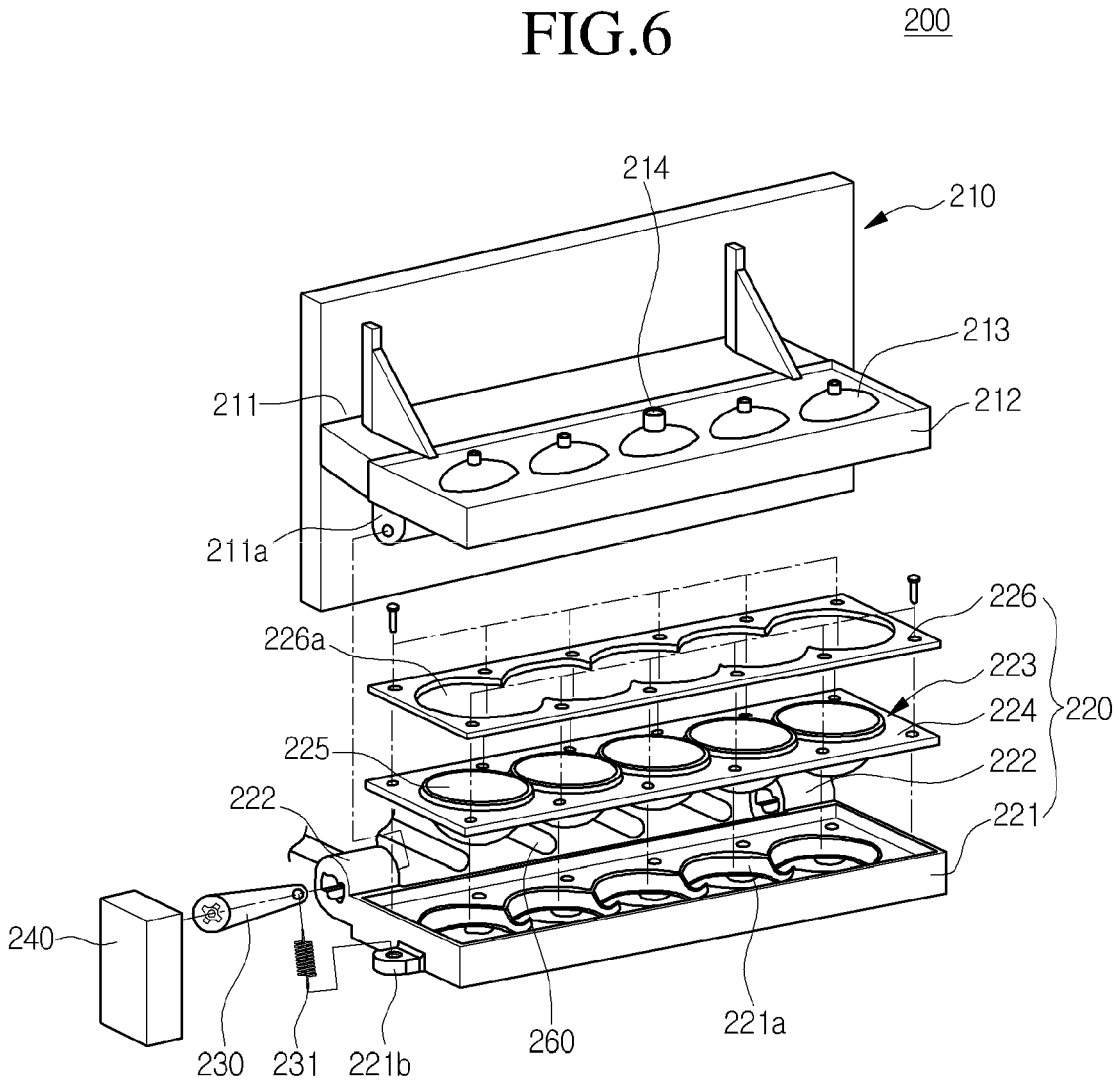
FIG. 6 is an exploded perspective view of an example ice maker.

FIG. 6 illustrates an example ice maker.

Referring to FIG. 6, the ice maker 200 is mounted on an ice maker bracket (see reference numeral 250 of FIG. 7) disposed on the barrier 111. Also, the ice maker 200 includes an upper plate tray 210, a lower plate tray 220 rotatably coupled to the upper plate tray 210, a motor assembly 240 providing rotation force to the lower plate tray 220, and an ejecting unit 260 separating ice made in the upper and lower plate trays 210 and 220.

For instance, the lower plate tray 220 has a substantially square shape when viewed from an upper side. Also, a recess part 225 recessed downward in a hemispherical shape to define a lower portion of a globular or spherical ice piece is defined in the lower plate tray 220. The lower plate tray 220 may be formed of a metal material. As necessary, at least a portion of the lower plate tray 120 may be formed of an elastically deformable material. In some implementations, a portion of the lower plate tray 220 is formed of an elastic material.

The lower plate tray 220 includes a tray case 221 defining an outer appearance thereof, a tray body 223 seated on the tray case 221 and having the recess part 225, and a tray cover 226 for fixing the tray body 223 to the tray case 221.

The tray case 221 may have a square frame shape. Also, the tray case 221 may further extend upward and downward along a circumference thereof. Further, a seat part **221*a* punched in a circular shape is disposed within the tray case 221. The seat part 221*a* may have a shape corresponding to that of the recess part 225 of the tray body 223 so that the recess part 225 is stably seated thereon. That is to say, the seat part 221*a* may be rounded with the same curvature as that of the recess part 225. Thus, when an outer circumferential surface of the recess part is closely attached to the seat part 221***a*, the tray body 223 may be stably seated on the tray case 221 without being shaken.

The seat part 221*a* may be provided in plurality to correspond to the position and shape of the recess part 225. Thus, the plurality of seat parts 221*a* may be connected to each other.

Also, a lower plate tray connection part 222 coupled to the upper plate tray 210 and the motor assembly 240 so that the tray case 221 is rotatably mounted is disposed on a rear side of the tray case 221.

In addition, an elastic member mounting part 221*b* is disposed on a side surface of the tray case 221. Further, an elastic member 231 providing elastic force to maintain a closed state of the lower plate tray 220 may be connected to the elastic member mounting part 221*b*.

The tray body 223 may be formed of an elastically deformable flexible material. The tray body 223 is seated on the tray case 221. The tray body 223 includes a plane part 224 and the recess part 225 recessed downward from the plane part 224. The plane part 224 has a plate shape with a predetermined thickness. Also, the plane part 124 may have a shape to correspond to that of a top surface of the tray case 221 so that the plane part 124 is accommodated into the tray case 221. In addition, the recess part 225 may have the hemispherical shape to define a lower portion of a globular or spherical cell providing a space in which an ice piece is made. In some implementations, the recess part 213 may have a shape corresponding to that of a recess part 225 of the upper plate tray 210. Thus, when the upper plate tray 210 and the lower plate tray 220 are closed, the shell providing a space having a globular or spherical shape may be defined.

The recess part 225 may pass through the seat part 221*a* of the tray case 221 to protrude downward. Thus, the recess part 225 may be pushed by the ejecting unit 260 when the lower plate tray 220 rotates. As a result, an ice within the recess part 225 may be separated to the outside.

Also, a lower protrusion protruding upward is disposed around the recess part 225. When the upper plate tray 210 and the lower plate tray 220 are closed with respect to each other, the lower protrusion may overlap an upper protrusion of the upper plate tray 210 to reduce (e.g., prevent) water from leaking.

The tray cover 226 may be disposed above the tray body 223 to fix the tray body 223 to the tray case 221. A screw or rivet may be coupled to the tray cover 226. The screw or rivet successively passes through the tray cover 226, the tray body 223, and the tray case 221 to assemble the lower plate tray 220.

A punched part 226*a* having a shape corresponding to that of an opened top surface of the recess part 225 defined in the tray body 223 is defined in the tray cover 226. The punched part 226*a* may have a shape in which a plurality of circular shapes successively overlap each other. Thus, when the lower plate tray 220 is completely assembled, the opened top surface of the recess part 225 is exposed through the punched part 226*a*. Also, the lower protrusion protruding upward from an edge of a top surface of the recess part 225 is disposed inside the punched part 226*a*.

The upper plate tray 210 defines an upper appearance of the ice maker 200. The upper plate tray 210 may include a mounting part 211 for mounting the ice maker 200 and a tray part 212 for making ice.

For instance, the mounting part 211 is configured to mount the ice maker 200 inside the freezing compartment 113. The mounting part 211 may extend in a vertical direction perpendicular to that of the tray part 212. Thus, the mounting part 211 may surface-contact the freezing compartment 113 to maintain a stably mounted state thereof.

Also, the tray part 212 may have a shape corresponding to that of the lower plate tray 220. The tray part 212 may include a plurality of recess parts 213 each being recessed upward and having a hemispherical shape. The plurality of recess parts 213 are successively arranged in a line. When the upper plate tray 210 and the lower plate tray 220 are closed, the recess part 225 of the lower plate tray 220 and the recess part 213 of the upper plate tray 210 are coupled to match each other to define the shell which provides an ice making space having a globular or spherical shape. The recess part 213 of the upper plate tray 210 may have a hemispherical shape corresponding to that of the lower plate tray 220.

A shaft coupling part 211*a* to which the lower plate tray connection part 222 is shaft-coupled may be further disposed on a rear side of the tray part 212. The shaft coupling part 211*a* may extend downward from both sides of a bottom surface of the tray part 212 and be shaft-coupled to the lower plate tray connection part 222. Thus, the lower plate tray 220 may be shaft-coupled to the upper plate tray 210 and be rotatably mounted on the upper plate tray 220. That is, the lower plate tray 220 may be rotatably opened or closed by the rotation of the motor assembly 240.

The upper plate tray 210 may be formed entirely of a metal material. Thus, the upper plate tray 210 may be configured to quickly freeze water within the shell. Also, a heater for heating the upper plate tray 210 to separate ice from the upper plate tray 210 may be disposed on the upper plate tray 210. Further, a water supply tube for supplying water into a water supply part 214 of the upper plate tray 210 may be disposed above the upper plate tray 210.

The recess part 213 of the upper plate tray 210 may be formed of an elastic material, like the recess part 225 of the lower plate tray 220, so that ice is easily separated.

A rotating arm 230 and the elastic member 231 are disposed on a side of the lower plate tray 220. The rotating arm 230 may be provided for the tension of the elastic member 231. The rotating arm 230 may be rotatably mounted on the lower plate tray 220. The rotating arm 230 has one end shaft-coupled to the lower plate tray connection part 222. Also, the elastic member 231 has both ends connected to the end of the rotating arm 230 and the elastic member mounting part 221*b*. Further, in the state where the lower plate tray 220 and the upper plate tray 210 are closely attached and thus completely closed, the rotating arm 230 may further rotate to tension the elastic member 231. As a result, the lower plate tray 220 may be closely attached to the upper plate tray by restoring force through which the elastic member 231 is contracted to reduce (e.g., prevent) water from leaking.

In the state where the lower plate tray 220 is closed, the rotating arm 230 further rotates in the direction in which the lower plate tray 220 is closely attached to the upper plate tray 210 to tension the elastic member 231. Thus, the lower plate tray 220 may be closely attached to the upper plate tray 210 by the restoring force of the elastic member 231 to reduce (e.g., prevent) water from leaking.

The motor assembly 240 may be disposed on a side of the upper and lower plate trays 210 and 220 and include a motor. Also, the motor assembly may include a plurality of gears that are combined with each other to adjust the rotation of the lower plate tray 220.

Figure 7:
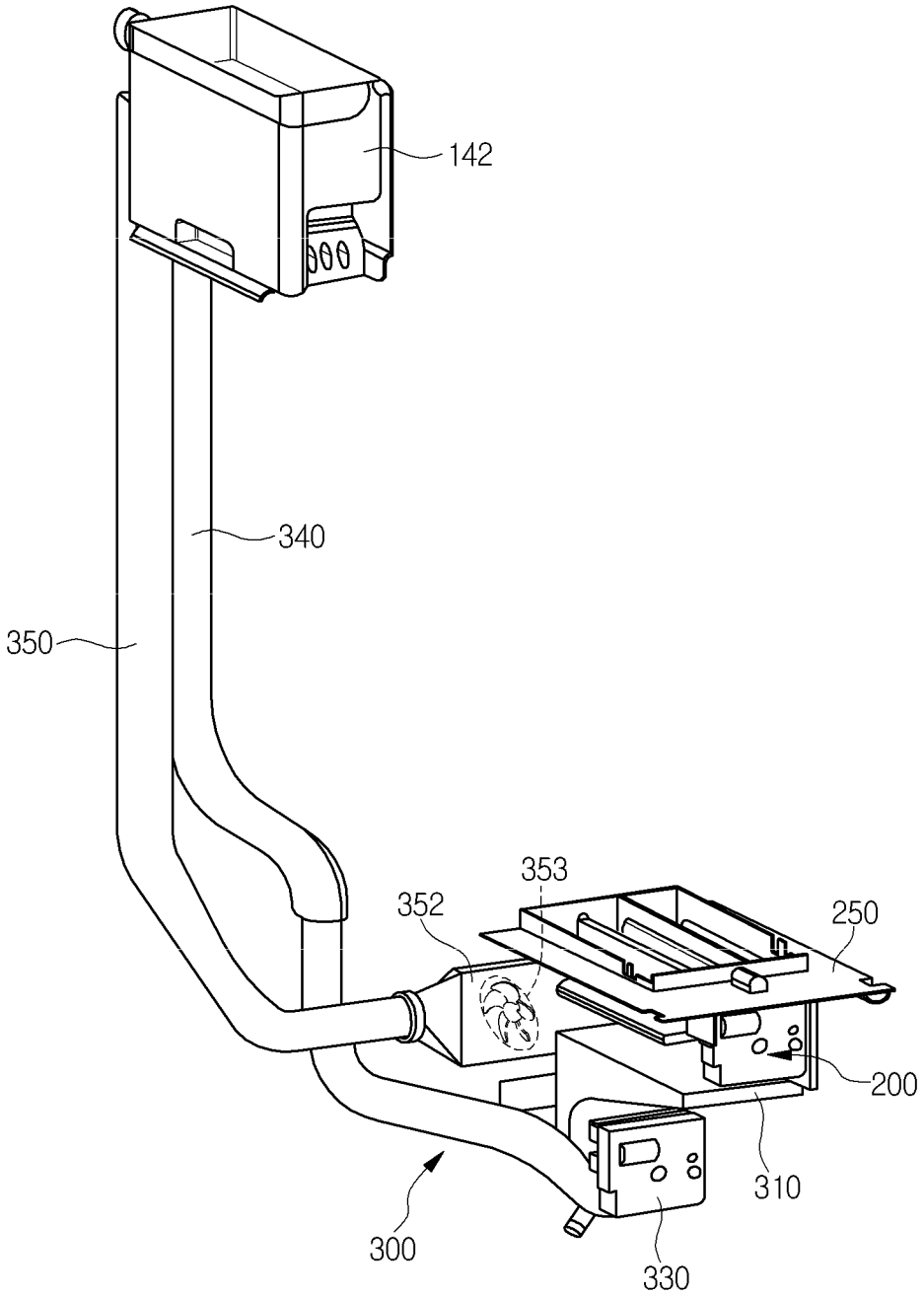
FIG. 7 is a perspective view illustrating an example overall structure of an example ice transfer device.
Figure 8:
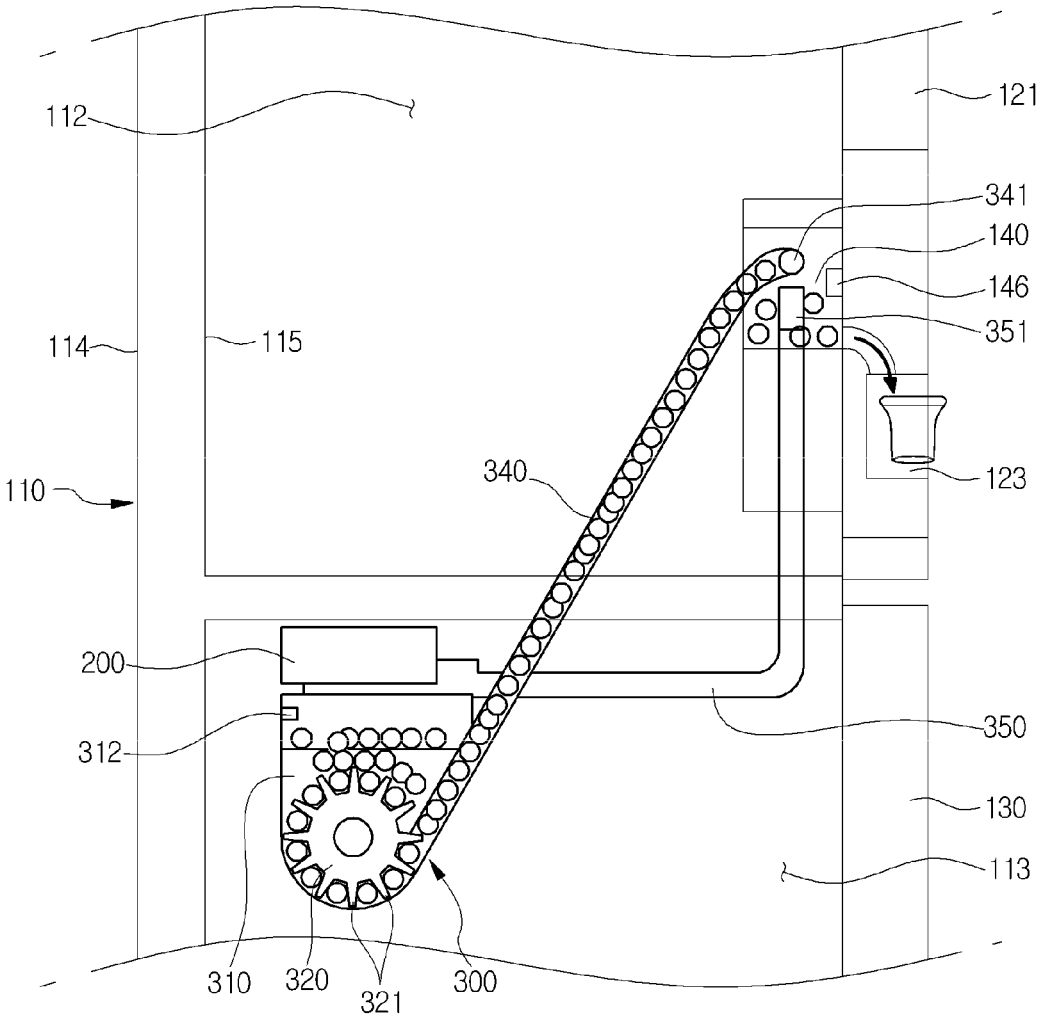
FIG. 8 is a schematic view illustrating an example ice transfer state through the ice transfer device shown in FIG. 7.

FIG. 7 illustrates an example overall structure of an example ice transfer device, and FIG. 8 illustrates an example ice transfer state through the example ice transfer device.

Referring to FIGS. 7 and 8, the ice transfer device 300 is disposed in the freezing compartment 113 and connected to the ice bank 140 via the freezing compartment 113, the refrigerating compartment 112, and the first refrigerating compartment door 121 to supply ice made in the ice maker 200 into the ice bank 140.

The ice transfer device 300 may be mounted within an inner case 115 defining an inner surface of the cabinet 110 and be exposed to the inside of the refrigerator. Here, the ice transfer device 300 may be mounted on a member such as a separate bracket coupled to the inner case 115. Also, at least one portion of the ice transfer device 300 may be buried by an insulation material between an outer case 114 and the inner case 115 of the cabinet 110 to provide insulation properties.

The ice transfer device 300 includes the housing 310 in which ice separated from the ice maker 200 is primarily stored, the transfer member 320 disposed within the housing 310 to transfer the ice within the housing 310, a driving unit 330 for rotating the transfer member 320, and the ice chute 340 for guiding the ice within the housing 310 up to the dispenser 123.

The housing 310 is disposed under the ice maker 200. Also, a space for accommodating ice and the transfer member 320 is defined within the housing 310. Further, the housing 310 may have an opened top surface to allow the ice supplied from the ice maker 200 to drop therein and be accommodated.

In some implementations, the top surface of the housing 310 may be disposed under the ice maker 200 and exposed to the inside the freezing compartment 113. Also, a lower portion of the housing 310 in which the transfer member 320 is accommodated may be buried in the insulation material between the outer case 114 and the inner case 115.

The transfer member 320 may have a gear or impeller shape. Hereinafter, the gear or impeller may be referred to as a lifter that lifts ice upward. Also, the globular or spherical ice pieces made in the ice maker 200 may be accommodated between the plurality of lifters 321 disposed on the transfer member 320. In addition, the lifters 321 may rotate to lift the ice pieces, thereby pushing the ice pieces toward the ice chute 340.

In some examples, the whole transfer member 320 may be accommodated in the housing 310. A rotation shaft of the transfer member 320 passes though the housing 310 and is exposed to the outside of the housing 310. Also, the driving unit 330 is connected to the rotation shaft of the transfer member 320 to provide a power for rotating the transfer member 320.

The driving unit 330 includes a driving motor for providing rotation power and a gear assembly rotated by the driving motor. The gear assembly may be provided in plurality. Also, a plurality of gears may be combined with each other to control a rotation rate of the transfer member 320.

The ice chute 340 extends from a side of the housing 310 up to the first refrigerating compartment door 121 on which the ice bank 140 is mounted. Thus, the ice chute 340 may have a hollow tube shape so that globular or spherical ice pieces are transferred therethrough. The ice chute 340 may have an inner diameter corresponding to that of a globular or spherical ice piece or slightly greater than that of the globular or spherical ice piece. Thus, the made ice pieces may be successively transferred in a line.

The ice chute 340 may extend to pass through the barrier 111. Also, the ice chute 340 may be mounted so that the ice chute 340 is exposed to the inside of the freezing compartment 113 and the refrigerating compartment 112. For instance, the insulation member may be further provided outside the ice chute 340 to reduce (e.g., prevent) heat exchange between the refrigerating compartment 112 and the ice chute 340.

The ice chute 340 may be disposed between the outer case 114 and the inner case 115. That is, the ice chute 340 may be disposed in a sidewall of the cabinet 110 corresponding to the first refrigerating compartment door 121. For instance, the ice chute 340 may be thermally insulated by the insulation material within the cabinet 110 and not be exposed to the inside of the refrigerator.

The ice chute 340 may extend up to an inner sidewall of the refrigerating compartment 112 corresponding to a position of the ice bank 140. Also, the opening 341 opened in the inner wall of the refrigerating compartment 112 is defined in an upper end of the ice chute 340.

Thus, when the first refrigerating compartment door 121 is closed, the ice bank 140 and the ice chute 340 may communicate with each other. Thus, ice pieces may move along the ice chute 340 by the rotation of the transfer member 320 and be supplied into the ice bank 140.

The cold air duct 350 may be disposed along the refrigerating compartment 112 at a side of the freezing compartment 113. Also, the cold air duct 350 may be buried within the cabinet 100, like the ice chute 340. The cold air duct 350 communicates with the ice bank 140 in the state where the first refrigerating compartment door 121 is closed to supply cool air within the freezing compartment 113 into the ice bank 140. Thus, the cool air supplied into the cold air duct 350 cools the inside of the ice bank 140. Then, the cool air may return to the freezing compartment 113 through the ice chute 340 to realize the circulation of the cool air.

When the refrigerator 1 is operating, cool air generated in the evaporator may be supplied into the ice maker 200 that is disposed inside the freezing compartment 113. Globular or spherical ice may be made inside the ice maker 200 by using water supplied into the ice maker 200. When the ice is completely made, the ice drops down by the heater provided in the ice maker 200 or a component for separating the ice.

An upwardly opened inlet of the housing 310 may be defined under the ice maker 200, and thus the made globular or spherical ice may be supplied into the housing 310. The ice supplied through the upper side of the housing 310 may move according to the rotation of the transfer member 320.

For instance, the plurality of lifters 321 are disposed on the transfer member 320. A space in which each of the globular or spherical ice pieces is accommodated one by one is defined between the lifters 321. Thus, the ice introduced into the housing 310 is accommodated into the space between the plurality of lifters 321 disposed on the transfer member 320 by the rotation of the transfer member 320.

The ice pieces accommodated in the spaces defined in the transfer member 320 may be transferred by the rotation of the transfer member 320. Thus, the ice chute 340 may be maintained in a state where made ice pieces fully fill the inside of the ice chute 340. Here, the transfer member 320 may rotate to push the ice within the ice chute 340, thereby discharging the ice into the ice bank 140.

The ice discharged into the ice bank 140 is stored in the ice bank 140. The ice stored in the ice bank 140 may be dispensed through the dispenser 123 when the dispenser 123 is manipulated.

Also, a full ice detection device 146 may be provided in the ice bank 140. In addition, a full ice detection device 312 may be provided inside the housing 310. A preset amount or more of ice may be filled into the ice bank 140 and the housing 310 based on output from the full ice detection device disposed in each of the ice bank 140 and the housing 310. Further, the operation of the ice maker 200 may be controlled by the full ice detection device until the preset amount or more of ice is filled in the ice bank 140 and the housing 310. In this state, the transfer member 320 may operate to supply the ice into the ice bank 140.

When a user manipulates the dispenser 123 in the state where the ice bank 140 is fully filled with ice, the operation of the driving unit 330 may start. When the transfer member 320 is rotated, the ice accommodated in the space defined in the transfer member 320 may rotate together to push the ice accommodated in a lower end of the ice chute 340 upward. When the ice accommodated in the lower end of the ice chute 340 is pushed upward, the ice pieces successively stacked within the ice chute 340 may be pushed at the same time to ascend upward. Also, globular or spherical ice pieces may be supplied into the ice bank 140 through the opening 341 of the ice chute 340. Then, the ice pieces may be dispensed to the outside through the dispenser 123.

In some implementations, each of the ice pieces dispensed through the dispenser 123 may have a globular shape, and also, the user may dispense the desired number of ice pieces by manipulating the dispenser 123.

The operation of the driving unit 330 may be restricted by a door sensor for detecting an opening/closing of the refrigerating compartment door 120. That is, when the user manipulates the dispenser 123 in a state where the refrigerating compartment door 120 is opened, the driving unit 330 may not operate to prevent ice from being dispensed.

A predetermined amount of ice may be accommodated in the housing 310. Thus, the globular or spherical ice pieces may be successively transferred by the rotation of the transfer member 320. That is, ice pieces corresponding to the number of dispensed ice pieces may be supplied into the ice chute 340 to maintain a state in which the ice chute 340 is fully filled with ice.

Also, the ice pieces may adhere to each other within the housing 310 or the ice chute 340, or the ice pieces may not be smoothly transferred due to foreign substances. In this state, when the transfer member 320 rotates, a load above a preset load may be applied. Thus, when the load above the preset load is detected from the driving unit 330, the motor of the driving unit 330 may rotate in reverse.

When the driving unit 330 rotates in reverse, the transfer member 320 may rotate in reverse. Thus, ice pieces accommodated in the spaces of the transfer member 320 may move into the housing 310. Also, ice pieces within the ice chute 340 may smoothly move downward by the weight of gravity. Then, the ice pieces may move downward along the inclined ice chute 340. The ice pieces moving downward may be accommodated in the spaces of the transfer member 320 which reversely rotates, and then the ice pieces may successively move into the housing 310.

In some examples, the driving unit 330 may reversely rotate for a preset time to completely empty the inside of the ice chute 340. In this state, the driving unit 330 may forwardly rotate to successively supply the ice pieces accommodated in the spaces of the transfer member 320 into the ice chute 340. Then, a process for transferring ice may be prepared.

While the ice is transferred, if two or more ices are put into the space defined between the lifters 321, the two or more ices may jam or collide with each other and thus be damaged. Thus, a unit to reduce the above-described phenomenon from occurring may be used.

Hereinafter, an ice jam or damage prevention unit for controlling ice pieces so that the ice pieces are put into the spaces defined between the lifters 321 of the transfer member 320 one by one when the transfer member 320 rotates to transfer the ice pieces will be described.

Figure 9:
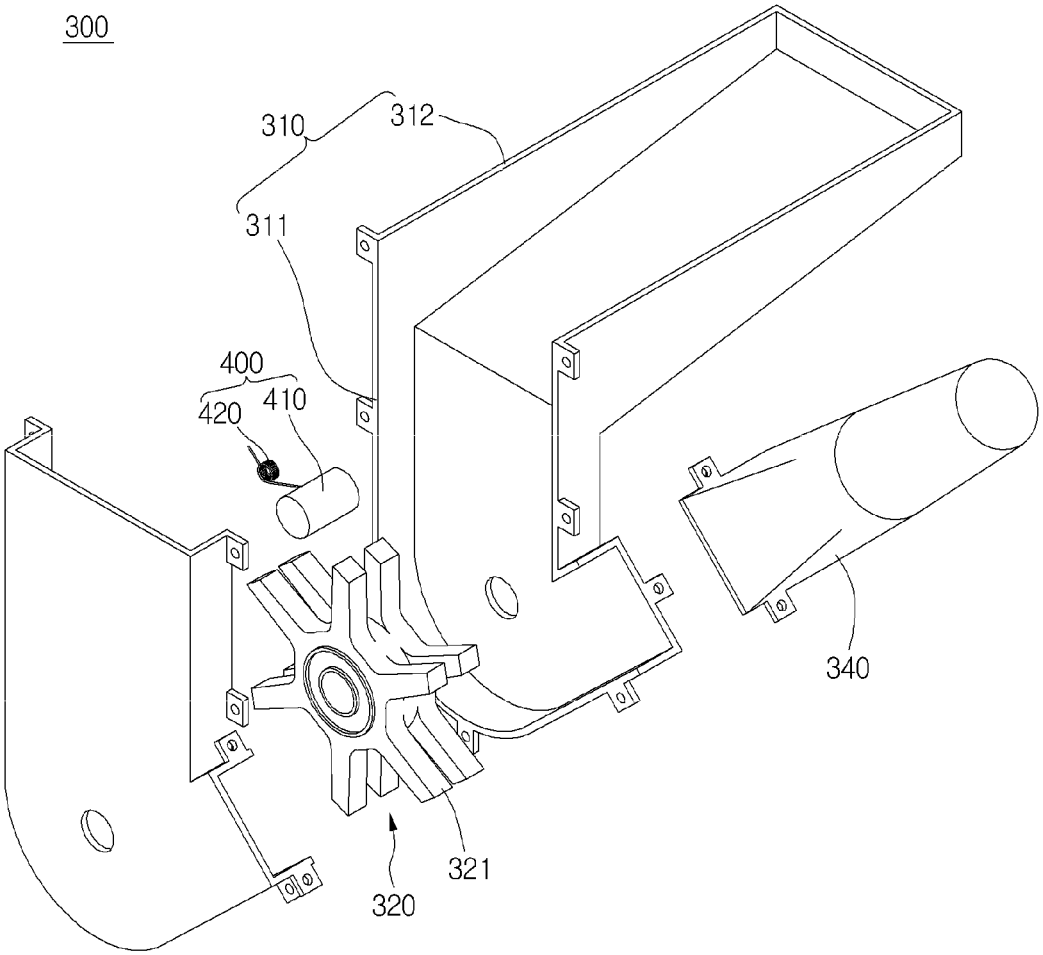
FIG. 9 is an exploded perspective view of an example ice transfer device including an example ice jam or damage prevention unit.

FIG. 9 illustrates an example ice transfer device including an example ice jam or damage prevention unit.

Referring to FIG. 9, an ice transfer device 300 including an ice jam or damage prevention unit includes a housing 310, a transfer member 320 accommodated in the housing 320, and an ice chute 340 connected to the housing 320.

For instance, the housing 310 includes an ice bin 312 in which ice pieces made in an ice maker 200 are temporarily stored and a transfer case 311 connected to an end of a side of the ice bin 312 to accommodate the transfer member 320 therein. Also, the ice chute 340 is connected to a side of the transfer case 311. The ice chute 340 may be integrated with the transfer case 311 as one body, or a separate chute may be connected to the transfer case 311.

A lifter 321 constituting the transfer member 320 may be provided in plurality. The plurality of lifters 321 may radially extend from a rotation center of the transfer member 320. Also, when the transfer member 320 rotates, ice pieces within the ice bin 312 may drop into a space between the lifters 321 adjacent to each other.

In addition, an ice jam or damage prevention unit 400 may be provided for blocking an ice piece from entering the vicinity of an inlet of the ice chute 340 because two or more ice pieces of globular or spherical ice pieces dropping from the ice bin 312 drop into the space between the lifters 321 adjacent to each other.

In some examples, the ice jam or damage prevention unit 400 includes a tensioner 410 disposed at a position spaced upward from an end of the lifter 321 and an elastic member 420 connected to the tensioner 410. The tensioner 410 is disposed in the vicinity of an opened end of the ice bin 312 and spaced a predetermined distance from a rotation radius of the lifter 321. Also, the elastic member 420 may be slightly bent upward or downward by kinetic energy of the ice pieces dropping from the ice bin 312 and then return to its original position. The elastic member 420 includes a torsion spring fixed to a side of the ice transfer device 300.

Figure 10:
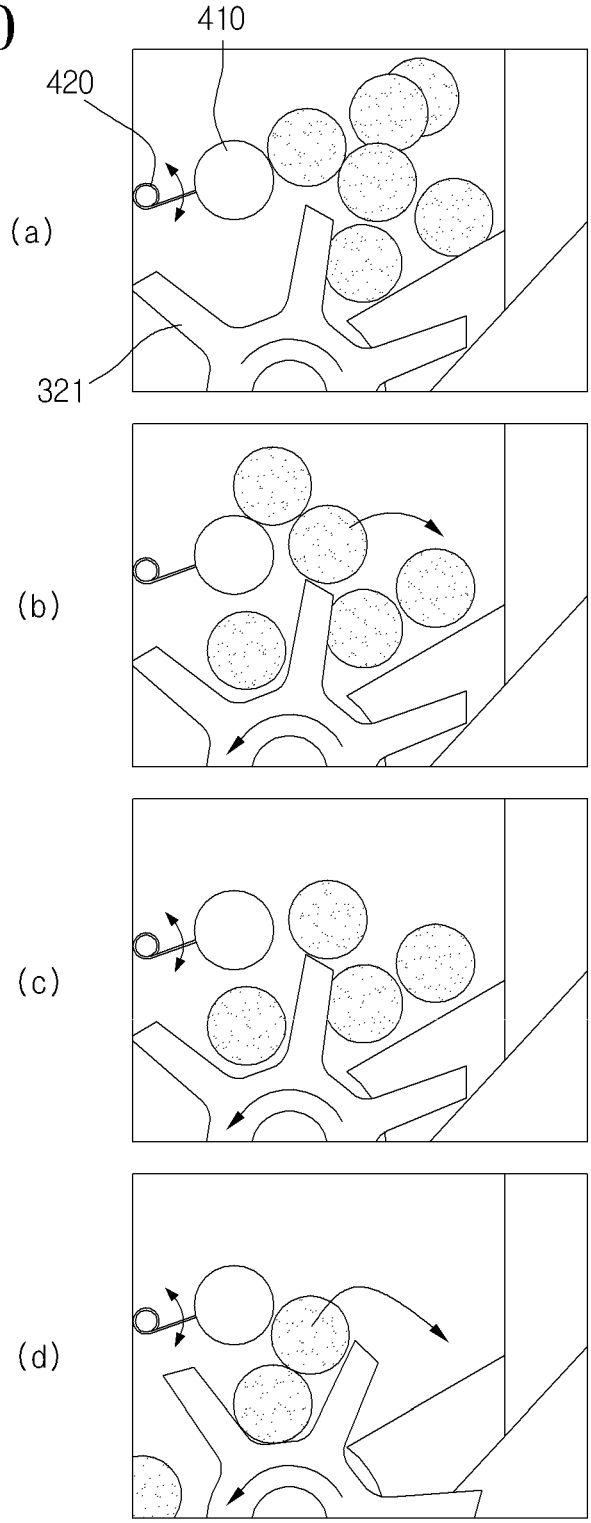
FIG. 10 is a view illustrating an example operation state of the ice jam or damage prevention unit shown in FIG. 9.

The ice jam or damage prevention unit 400 may be configured to put only one ice piece into the space between the lifters 321 when a plurality of ices drop from the ice bin 312 into the transfer member 320. That is, when the transfer member 320 rotates, the tensioner 410 may push the ice pieces out except for only one of the plurality of ice pieces. FIG. 10 illustrates an example operation state of the ice jam or damage prevention unit shown in FIG. 9.

Referring to FIGS. 10A to 10D, a plurality of ice pieces may drop from the ice bin 312 and then be put into the space between the lifters 321 adjacent to each other. However, since the tensioner 410 is disposed above the transfer member 320, the ice pieces may collide with each other and thus be pushed against each other. Also, when two ice pieces are put into the spaces between ends of the lifters 321, the upper ice piece may be pushed into the next space by the tensioner 410. Thus, only one ice piece may be accommodated into one space. Here, the tensioner 410 may be slightly bent upward or downward by the kinetic energy of the ice pieces. However, the tensioner 410 may return to its original position by the elastic force of the elastic member 420.

Figure 11:
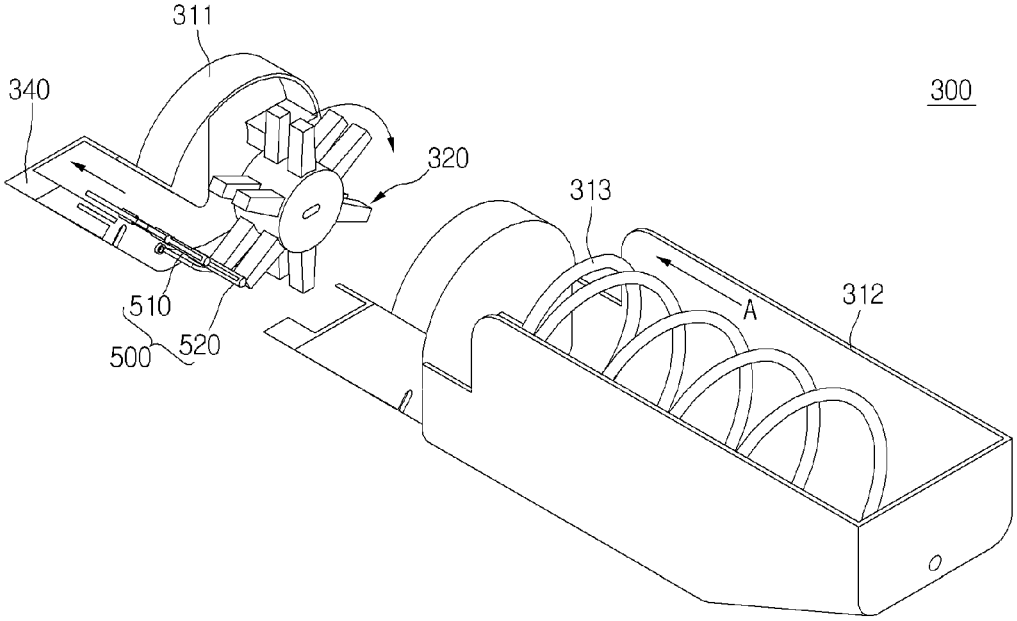
FIG. 11 is an exploded perspective view of another example ice transfer device including another example ice jam or damage prevention unit.

FIG. 11 illustrates another example ice transfer device including another example ice jam or damage prevention unit.

Referring to FIG. 11, an ice transfer device 300 including an ice jam or damage prevention unit includes a housing 310, a transfer member 320 accommodated in the housing 310, an ice chute 340 connected to the housing 320, and an ice jam or damage prevention unit 500.

In some implementations, the housing 310 includes an ice bin 312 in which ice pieces are temporarily stored and a transfer case 311 connected to an end of a side of the ice bin 312. Also, an auger 313 is disposed within the ice bin 312. The auger 313 may be connected to a rotation shaft of the transfer member 320 and thus integrally rotate with the transfer member 320. Alternatively, a separate driving motor for driving the auger 313 may be provided so that the auger 313 independently rotates with respect to the transfer member 320. The ice pieces stored in the ice bin 312 may be guided toward the transfer member 320 by the rotation of the auger 313. Also, the ice pieces may be guided toward the ice chute 340 by the rotation of the transfer member 320.

In some examples, the ice jam or damage prevention unit 500 includes a tensioner 510 to which a plurality of square plates are connected rotatable with respect to each other and an elastic member 520 connected to an end of the tensioner 510. As shown in FIG. 11, the tensioner 510 may be a plate assembly including a plurality of joints. The plates adjacent to each of the connection joints may be rotatable with respect to each other. Also, the tensioner 510 may have one end slidably fitted into the ice chute 340 and the other end rotatably connected to a lower end of the transfer case 311. Further, the elastic member 520 may be a torsion spring. The elastic member 520 may be fitted into a rotation shaft through which the other end of the tensioner 510 and the lower end of the transfer case 311 are connected to each other. In addition, the torsion spring has one end fixed to the tensioner 510 and the other end fixed to the transfer case 311. The tensioner 510 includes three plates which are rotatably connected to each other. One of the plates is slidably fitted into the ice chute 340 and the other two plates are rotatably connected to each other at their ends such that the two plates are bent in V shape.

Figure 12:
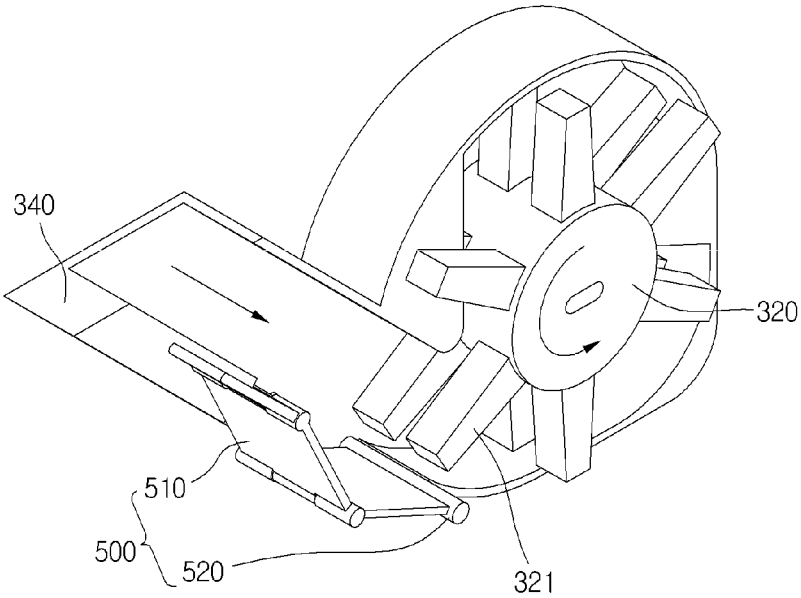
FIG. 12 is a view illustrating an example operation state of the ice jam or damage prevention unit shown in FIG. 11.
Figure 13:
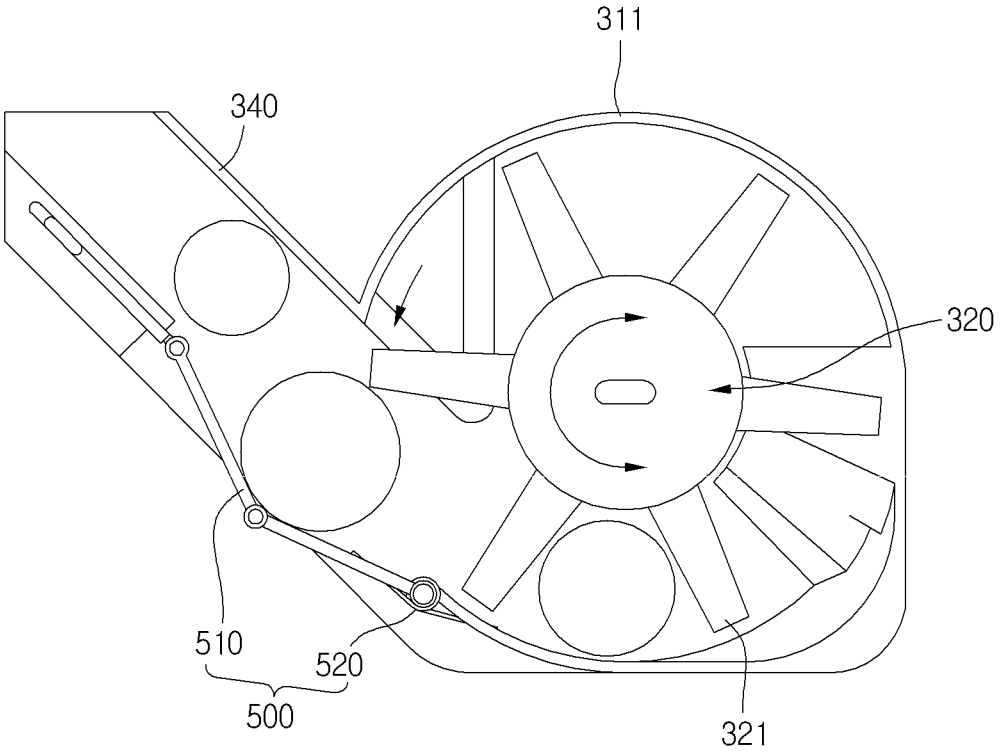
FIG. 13 is a side view illustrating the example operation state of the ice jam or damage prevention unit shown in FIG. 11.

FIGS. 12 and 13 illustrate an example operation state of the ice jam or damage prevention unit shown in FIG. 11.

Referring to FIGS. 12 and 13, the tensioner 510 has one end slidably fitted into the ice chute 340 and the other end rotatably connected to the transfer case 311. Also, at least two plates are rotatably connected to a portion of the inside of the tensioner 510. The portion to which the two plates are rotatably connected may be defined as a "rotation joint".

When ice pieces do not exist, the tensioner 510 may be maintained in a parallel state. However, when the transfer member 320 forwardly rotates to transfer ice pieces toward the ice chute 340, or reversely rotates to transfer ice pieces within the ice chute 340 toward the transfer member 320, as shown in FIG. 12, the tensioner 510 may be bent outward from the ice chute at a predetermined angle with respect to the rotation joint. Particularly, when the ice pieces within the ice chute 340 are reversely transferred, the tensioner 510 bends. For example, when the ice pieces having different diameters are arranged within the ice chute 340, or when lifters 321 of the transfer member 320 rotate to press the ice pieces placed on the tensioner 510, the tensioner 510 may be bent.

When the ice pieces are pressed by the lifters 321, the rotation joint of the tensioner 510 may be pushed outward, and thus, the tensioner 510 may be bent inward to prevent the pressed ice pieces from being damaged. Also, the pressed ice pieces may be introduced into the spaces between the lifters 321 adjacent to each other or ascend again toward the ice chute 340. Since the ice pieces ascend again toward the ice chute 340, the ice pieces arranged in a line within the ice chute 340 may be lifted upward to prevent the ice pieces from being jammed. Since only one ice piece is introduced into the space between the lifters 321 adjacent to each other, the ice jam phenomenon may be reduced (e.g., prevented).

When force applied to the tensioner 510 is removed, the rotation joint may return to its original position by restoring force of the elastic member 520.

As described above, according to the tensioner 510 having a flexible structure of which a portion of the inside is constituted by the rotation joint to be bent or curved, while the transfer member 320 reversely rotates, or the ice pieces within the ice chute 340 are transferred toward the transfer case 311, the jam or damage of the ice pieces may be significantly reduced (e.g., prevented).

Figure 14:
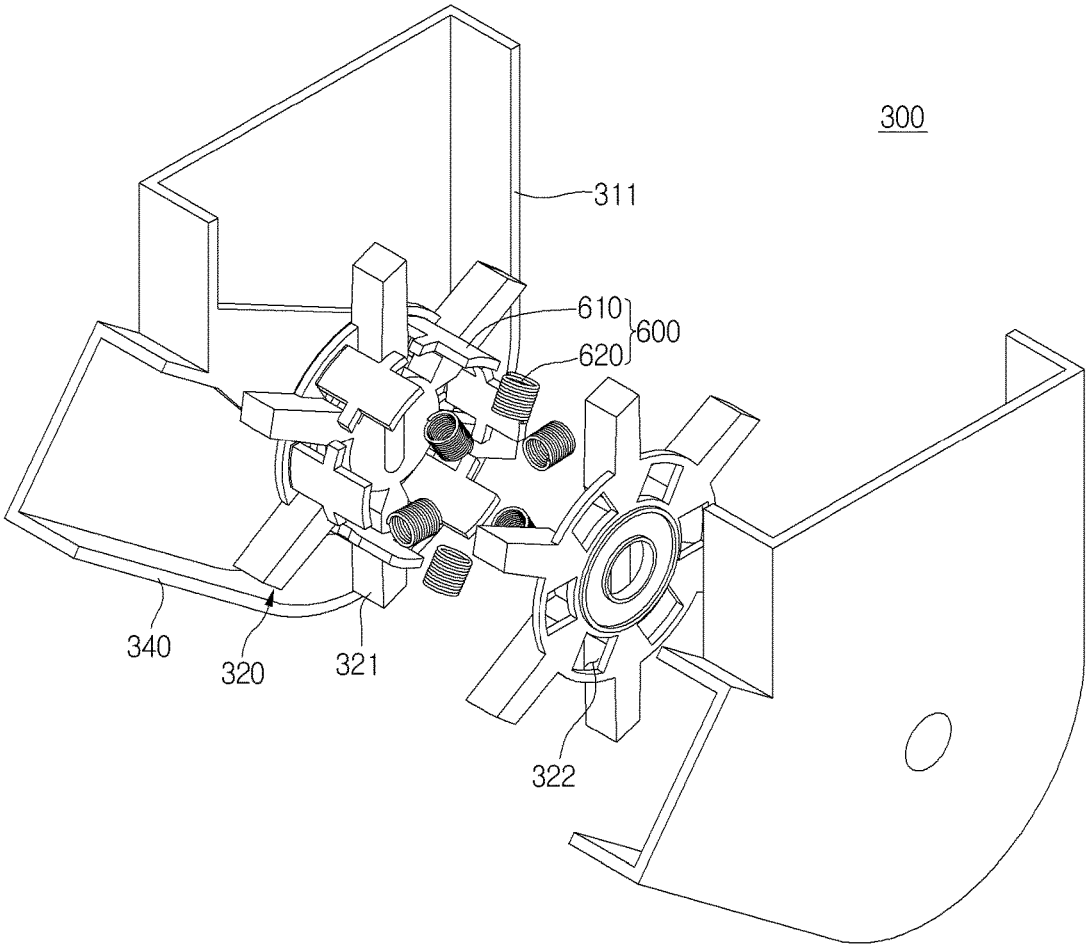
FIG. 14 is an exploded perspective view of another example ice transfer device including another example ice jam or damage prevention unit.

FIG. 14 illustrates another example ice transfer device including another example ice jam or damage prevention unit.

Referring to FIG. 14, an ice transfer device 300 including an ice jam or damage prevention unit includes a housing 310, a transfer member 320 accommodated in the housing 310, an ice chute 340 connected to the housing 320, and an ice jam or damage prevention unit 600.

For instance, the housing 310 includes an ice bin in which ice pieces are temporarily stored and a transfer case 311 connected to an end of a side of the ice bin.

The ice jam or damage prevention unit 600 includes a tensioner 610 disposed in a lower portion of a space between adjacent lifters 321 of the transfer member 320 and an elastic member 620 connected to a bottom surface of the tensioner 610 to give a cushion function to the tensioner 610.

For example, guide holes 322 in which both side ends of the tensioner 610 are fitted to support shaking in a radius direction of the transfer member 320 are defined in a side surface of the transfer member 320. Thus, in the state where the both side ends of the tensioner 610 are supported by the holes 322, the tensioner 610 may be shaken in the radius direction of the transfer member 320 along the guide holes 322.

The elastic member 620 may be a spring that is contractible or expandable in the radius direction of the transfer member 320. The elastic member 620 may support the bottom surface of the tensioner 610. An operation of the ice jam or damage prevention unit 600 will be described below.

Figure 15:
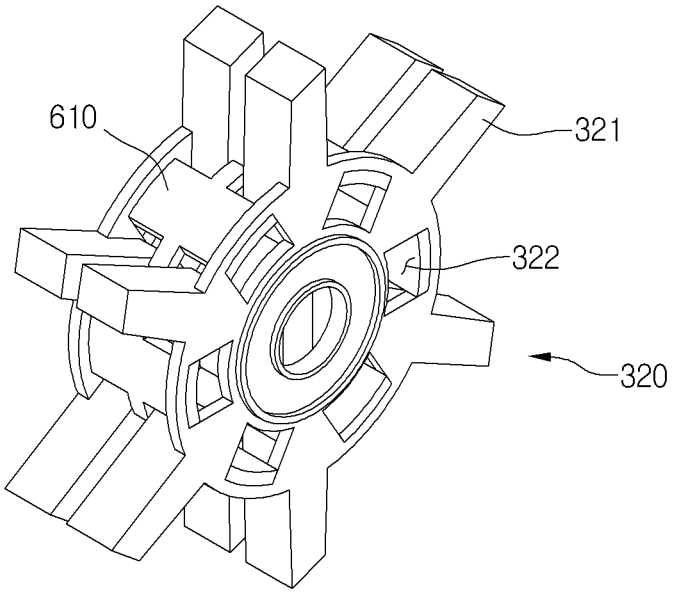
FIG. 15 is a perspective view of the ice jam or damage prevention unit shown in FIG. 14.
Figure 16:
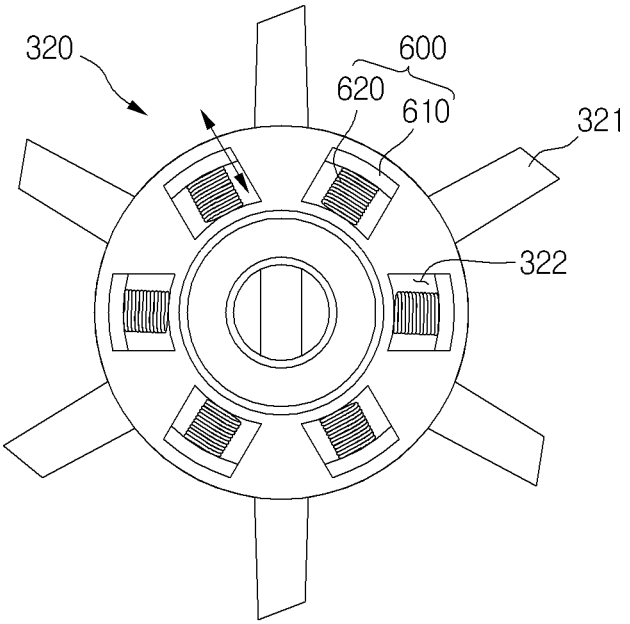
FIG. 16 is a side view of the ice jam or damage prevention unit shown in FIG. 14.

FIGS. 15 and 16 illustrate the ice jam or damage prevention unit shown in FIG. 14.

Referring to FIGS. 15 and 16, ice pieces dropping from the ice bin 312 may drop onto a top surface of the tensioner 610. Thus, the tensioner 610 may descend in a center direction of the transfer member 320 according to the contraction or expansion of the elastic member 620 by weight of the dropping ices.

For instance, each of the ice pieces dropping from the ice bin 312 may vary in size and weight according to a radius of a globular or spherical cell provided in the ice maker. That is, a made ice may vary in size and weight according to a standard of the ice maker. Here, the tensioner 610 may be variable so that ice pieces having various sizes and weights are accommodated, regardless of the standard of the ice maker. Thus, the jam phenomenon in which ice pieces are put between an inlet of the ice chute 340 and the transfer member 320 may be reduced (e.g., prevented). Also, when a load applied to the tensioner 610 is removed, the tensioner 610 may ascend to its original position by restoring force of the elastic member 620.

Figure 17:
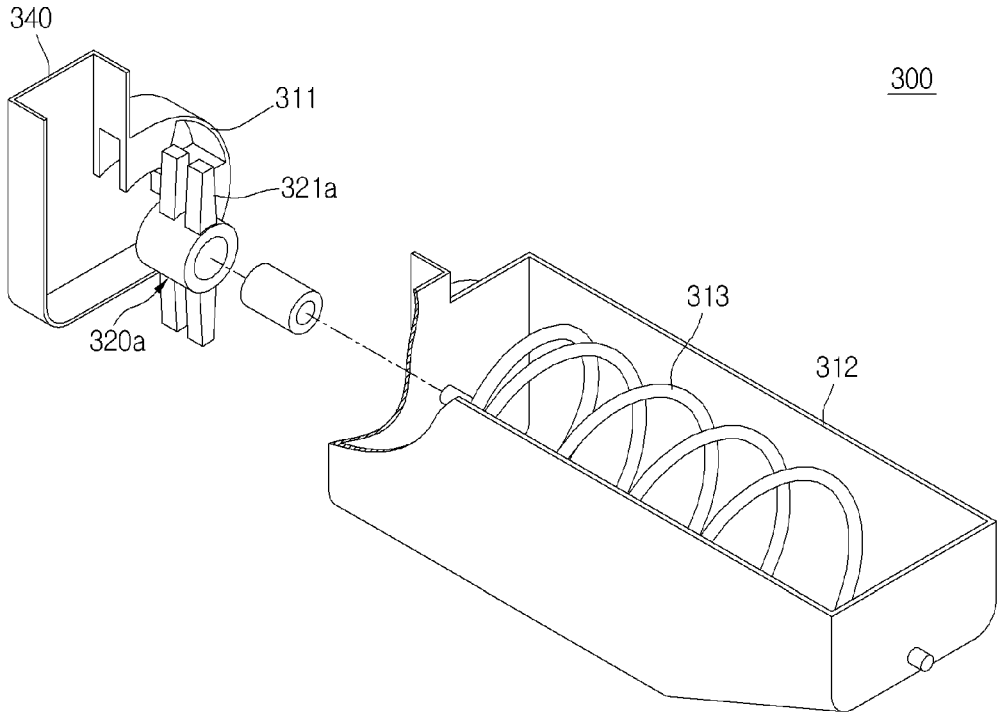
FIG. 17 is a perspective view of another example ice transfer device including another example ice jam or damage prevention unit.

FIG. 17 illustrates another example ice transfer device including another example ice jam or damage prevention unit.

Referring to FIG. 17, an ice transfer device includes a housing 310, a transfer member 320*a*, and an ice chute 340. The housing 310 includes an ice bin 312 including an auger 313 and a transfer case 311 accommodating the transfer member 320.

In the transfer member 320*a*, the lifters 321*a* disposed to face each other with respect to a rotational central shaft may radially extend to form a straight shape. In addition, since a one-way-bearing is disposed within the rotational central shaft of the transfer member 320*a*, when the auger 313 reversely rotates, the transfer member 320*a* may not rotate.

For instance, ice pieces within the ice chute 340 reversely rotate the auger 313 to reversely transfer the ice pieces into the ice bin 312. Before the auger 313 reversely rotates, the transfer member 320*a* forwardly rotates and then is stopped so that the straight-shaped lifters 321*a* are in a vertical state. Also, if the transfer member 320*a* does not rotate while the auger 313 reversely rotates, ice pieces cornered toward an outlet of the ice bin 312 may be transferred toward an opposite side by the reverse rotation of the auger 313. Thus, the outlet-side of the ice bin 312 may be empty to define a space. As a result, the ice pieces guided toward the ice chute 340 may drop by their own weight to return to the ice bin 312.

When the ice pieces within the ice chute 340 are reversely transferred toward the ice bin 312, since the lifters 321*a* are maintained in the vertical state even though the ice pieces having different sizes are introduced into the transfer case 311, the jam phenomenon in which the ice pieces are put into the space between each of the lifters 321*a* and the transfer case 313 may be reduced (e.g., prevented).

Since the ice maker is disposed in the freezing compartment, the space for storing foods in the back surface of the refrigerating compartment door may be secured to expand the storage capacity of the refrigerator.

Since the ice making process is performed in the freezing compartment, it may be unnecessary to continuously supply strong cool air into the refrigerating compartment door for making ice. As a result, the cooling efficiency and power consumption saving effect may be improved. Also, since the ice making process is performed within the freezing compartment, the ice making efficiency may be improved.

When ice pieces are dispensed from the ice making compartment to transfer the ice pieces from the ice making compartment into the ice bank, the phenomenon in which the plurality of ice pieces are dispensed at once to collide with each other or an overload is applied to the transfer unit to damage the parts may be reduced (e.g., prevented).

Although implementations have been described with reference to a number of illustrative examples thereof, it should be understood that numerous other modifications and implementations can be devised by those skilled in the art that will fall within the spirit and scope of the principles of this disclosure. More particularly, various variations and modifications are possible in the component parts and/or arrangements and fall within the scope of the disclosure, the drawings, and the appended claims. In addition to variations and modifications in the component parts and/or arrangements, alternative uses will also be apparent to those skilled in the art.

What is claimed is:

1. A refrigerator comprising:

a main body comprising a freezing compartment and a refrigerating compartment disposed above the freezing compartment:

a door configured to open and close at least a portion of the refrigerating compartment;

an ice maker disposed in the freezing compartment;

an ice bank disposed on a rear surface of the door and configured to store ice made in the ice maker;

an ice transfer device configured to transfer the ice made in the ice maker to the ice bank; and an ice chute that connects the ice transfer device to the ice bank and defines a transfer path for ice from the ice transfer device to the ice bank, wherein the ice transfer device comprises:

a housing in which ice separated from the ice maker drops;

a transfer member accommodated within the housing and configured to transfer ice from the housing into the ice chute; and an ice unit configured to reduce ice jamming or damage caused by interference with the transfer member based on at least one of ice being transferred into the ice chute by the transfer member and ice being transferred from the ice chute toward the transfer member, wherein the housing comprises:

an ice bin configured to store ice separated from the ice maker; and a transfer case disposed at an outlet of the ice bin and configured to receive the transfer member, wherein an inlet of the ice chute is connected to an outlet of the transfer case, wherein the ice unit is disposed at a location where the ice chute and the transfer case are connected to each other, and comprises:

a tensioner that includes a plurality of plates (i) connected to each other and (ii) configured to rotate with respect to each other at one or more connection portions, and an elastic member coupled to an end of the tensioner and configured to apply elastic force to the tensioner, wherein ice directly presses and bends the tensioner based on ice (i) being transferred to or from the ice chute and (ii) directly pressing on two or more of the plurality of plates to rotate the two or more plurality of plates with respect to each other, and wherein the elastic member is configured to return, by a restoring force, the tensioner to an original position based on removing pressure on the tensioner.

2. The refrigerator according to claim 1, wherein the ice maker comprises:

an upper plate tray having a plurality of hemispherical recess parts that define an upper half of a spherical ice piece; and a lower plate tray having a plurality of hemispherical recess parts that define a lower half of the spherical ice piece, the lower plate tray being rotatably connected to the upper plate tray.

3. The refrigerator according to claim 1, further comprising a cold air duct that connects the freezing compartment to the ice bank.

4. The refrigerator according to claim 3, wherein the ice chute and the cold air duct extend along a side surface of the main body, and communication holes configured to communicate with openings of the ice chute and the cold air duct are defined in a side surface of the ice bank, the communication holes being configured to communicate with the openings of the ice chute and the cold air duct based on the door being oriented in a closed position.

5. The refrigerator according to claim 1, wherein the transfer member comprises a plurality of lifters that radially extend from a rotation center of the transfer member, and ice supplied from the ice bin is accommodated in an accommodation space defined between adjacent lifters.

6. The refrigerator according to claim 1, wherein the tensioner has a first end slidably connected to the ice chute and a second end rotatably connected to the transfer case, and wherein the elastic member comprises a torsion spring fitted into a connection portion between the second end of the tensioner and the transfer case.

7. The refrigerator according to claim 6, wherein at least one of the one or more connection portions of the plurality of plates establishes a rotation joint such that the tensioner bends at the rotation joint according to a load or size of ice passing through the tensioner.

8. The refrigerator according to claim 1, further comprising an auger provided within the ice bin and configured to transfer ice toward the transfer case.

9. The refrigerator according to claim 1, wherein the ice unit is configured to reduce ice jamming or damage caused by interference with the transfer member based on ice being transferred into the ice chute by the transfer member.

10. The refrigerator according to claim 1, wherein the ice unit is configured to reduce ice jamming or damage caused by interference with the transfer member based on ice being transferred from the ice chute toward the transfer member.

11. The refrigerator according to claim 1, wherein each of the one or more connection portions is located between a respective pair of plates.

* * * * *